United States Patent [19]

Williams

[11] Patent Number: 4,890,818

[45] Date of Patent: Jan. 2, 1990

[54] DOOR FORCING APPARATUS

[76] Inventor: Marc G. Williams, 12 Kobb Blvd., N. Babylon, N.Y. 11703

[21] Appl. No.: 291,218

[22] Filed: Dec. 27, 1988

[51] Int. Cl.[4] ..... B66F 3/24

[52] U.S. Cl. ..... 254/93 R; 254/100; 254/104; 72/705; 29/239

[58] Field of Search ..... 254/93 R, 93 A, 100, 254/133 R, 104; 72/705; 269/43; 29/239

[56] References Cited

U.S. PATENT DOCUMENTS

| | | | |
|---|---|---|---|
| 3,741,029 | 6/1973 | Bellemare | 72/705 |
| 4,657,225 | 4/1987 | Hoehn et al. | 72/705 |
| 4,682,765 | 7/1987 | Mainville | 269/43 |
| 4,762,304 | 8/1988 | Hill | 254/93 R |
| 4,783,053 | 11/1988 | Yirmiyahu et al. | 254/93 R |

*Primary Examiner*—Judy Hartman
*Attorney, Agent, or Firm*—Michael I. Kroll

[57] ABSTRACT

The door forcing apparatus for forcing a door set in a door jamb comprises two side rails each having a substantially L-shaped cross section engagable with a beveled edge between the door jamb and the door, a plurality of nearly flat drive wedges pivotally mounted on the side rails adjacent their vertices each having a nearly flat foot oriented parallel to the door pivotally mounted adjacent their circular-arc-shaped edge pressible against the door, two adjustable braces each of which comprise a bracing hydraulic cylinder or a turnbuckle which is pivotally attached to each of the two side rails adjacent one end of the apparatus, two U-shaped-cross-sectioned drive rods on each of which the drive wedges connected to the side rails are pivotally mounted and two driving hydraulic cylinders, each of which has a piston rod pivotally attached to an end of one of the drive rods and whose cylinder is pivotally mounted on a support bracket at one end of a side rail.

8 Claims, 4 Drawing Sheets

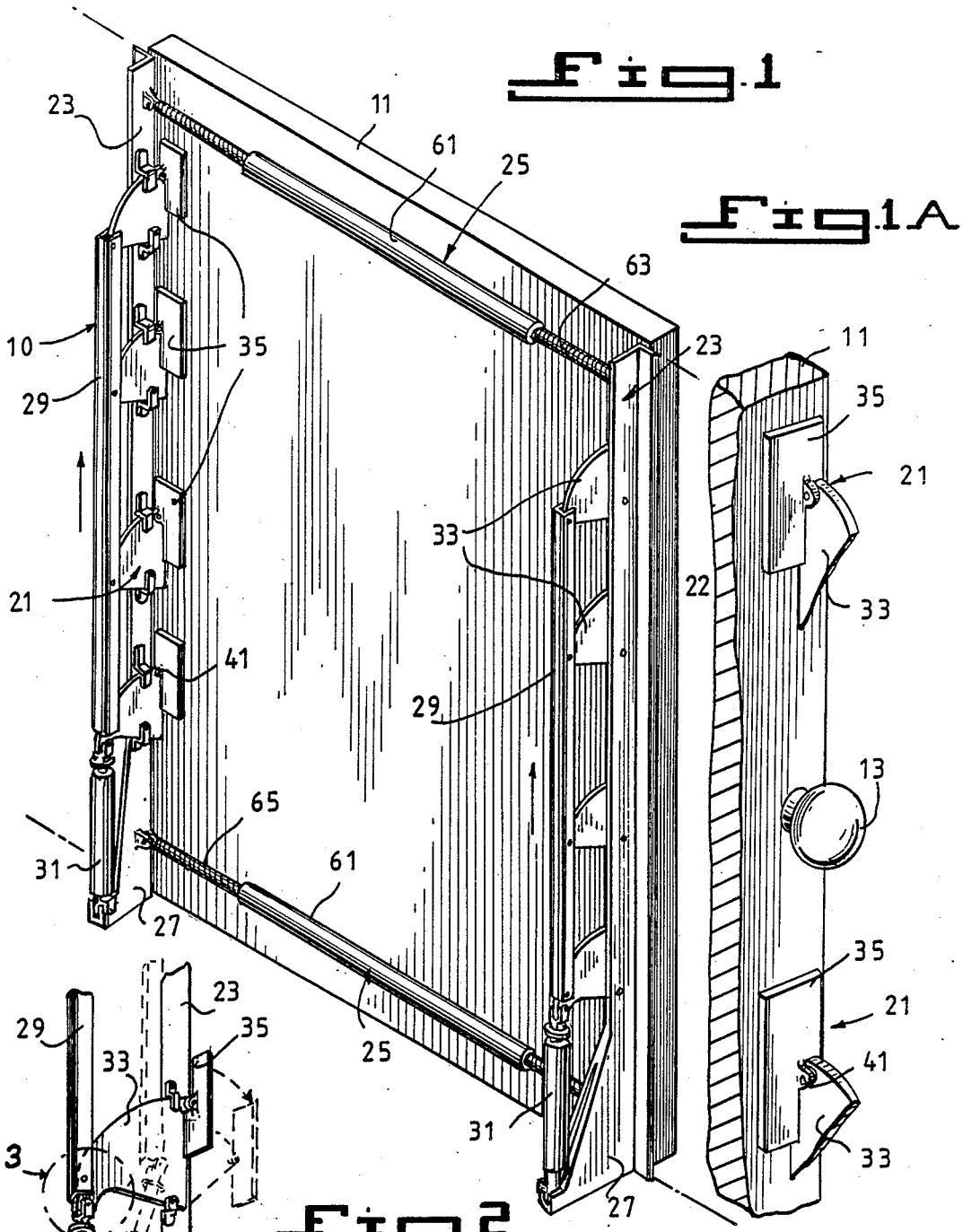
Fig. 1
Fig. 1A
23
11
61
25
63
10
35
29
21
41
33
22
13
65
31
27
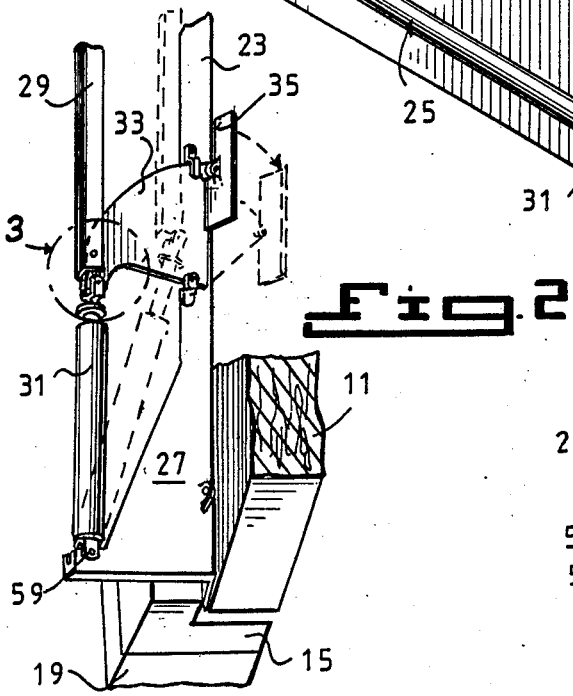
Fig. 2
29
23
35
33
3
31
11
27
59
19
15
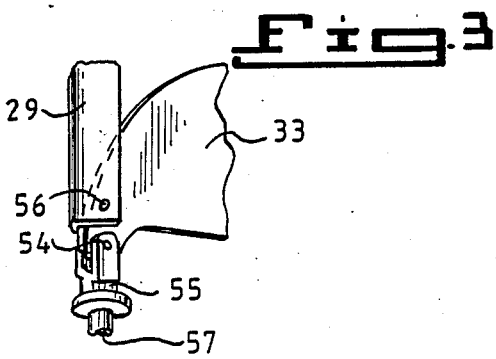
Fig. 3
29
33
56
54
55
57

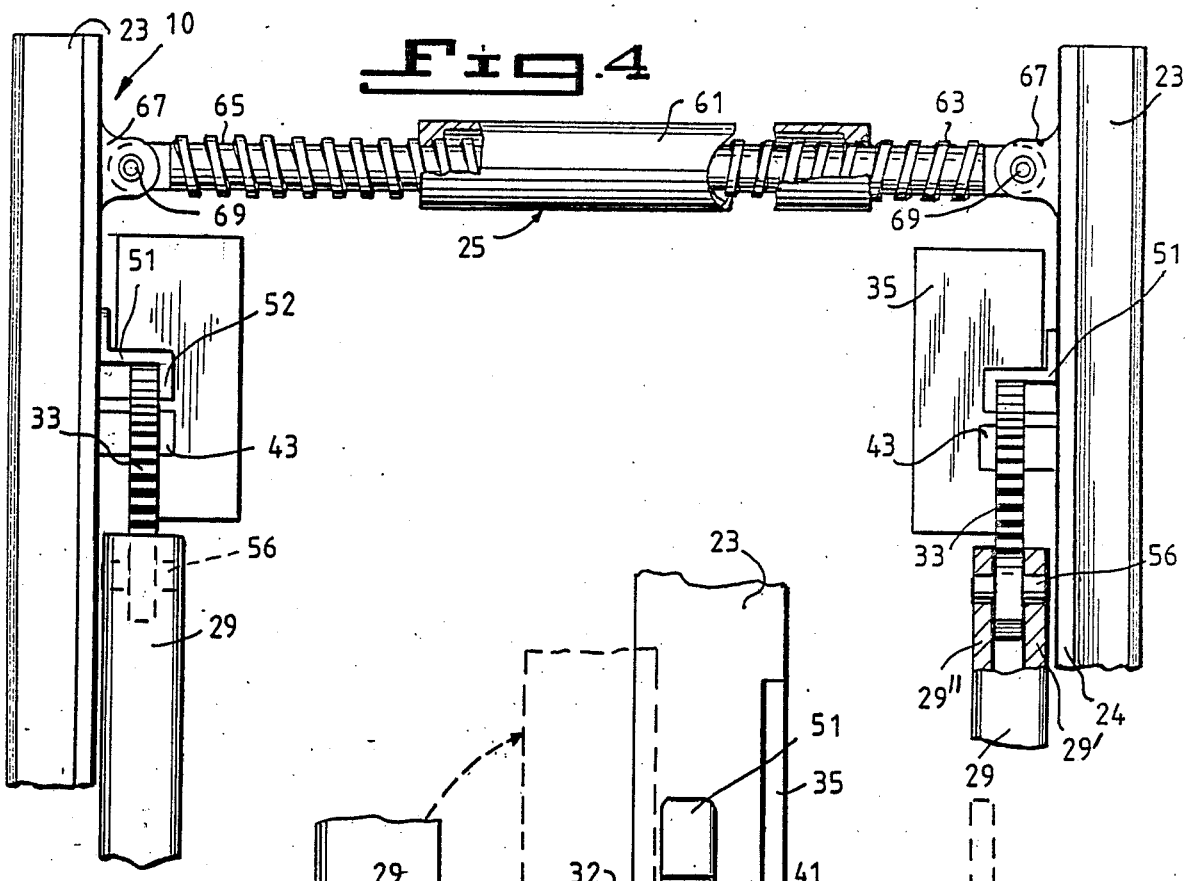
Fig.4
23
10
67
65
61
63
67
23
69
69
25
51
52
33
43
56
29
51
35
43
33
56
29''
24
29'
29
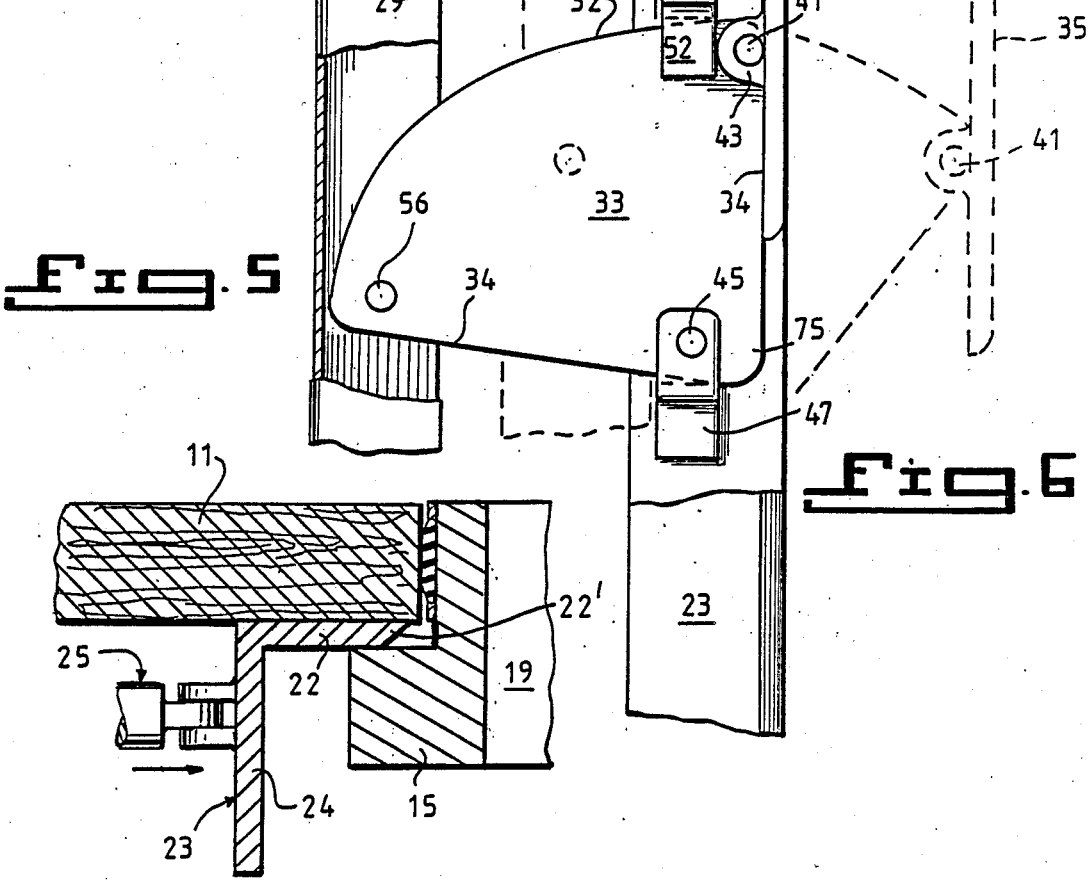
23
51
35
29
32
41
52
43
35
41
56
33
34
34
45
75
47
Fig.5
Fig.6
11
22'
23
25
22
19
24
15
23

HYDRAULIC CYLINDER
HYDRAULIC PUMP
ACCUMULATOR
EQUALIZER VALVES
HYDRAULIC CYLINDERS 69
23
10
25
91
89
83
81
85
22
24
67
87
33
54
55
31
22'
71
73

(PARTIALLY IN PLACE)

(FULLY IN PLACE)

DOOR FORCING APPARATUS

THE FIELD OF THE INVENTION

The present invention relates to means for forcible entry into a locked room, house, apartment and the like and, more particularly, to means for safely forcing a locked door which opens inward from the exterior, and with the use of accessories almost any door.

THE BACKGROUND OF THE INVENTION

Law enforcement or military personnel are required to make a forcible entry into a room in an apartment or hotel or into a house when it is necessary to make an arrest, rescue or for other purposes. Particularly anti-terrorist teams also need a rapid, safe means of forcing a door, often to save the lives of hostages.

Currently when an arrest of dangerous criminals who have locked themselves inside a room or a house must be made, armed law enforcement personnel surround the room or house and guard every possible exit from the room or house including doors and windows. Then they force the locked door to the room or house manually by crowbar, by kicking the locked door in with their feet or similar means and may enter the room or house with ready weapons in an effort to overcome any resistance to arrest without loss of life. However this is very dangerous procedure because the criminals who may be drug addicts or drug dealers determined to resist arrest by any means are often armed and shoot through the door, which is often only made of wood, to thwart any attempt to force the locked door and to prevent arrest, if they are aware that law enforcement personnel are approaching.

Furthermore some modern locked doors are comparatively strong, made of metal and very difficult to force manually or with a hand-held tool. Conventional means for forcing such a door are often noisy and give the occupants of the room or house advanced warning that the room or house is being entered. This is particularly a problem in hostage-terrorist situations where these conventional means are often too slow.

It is an object of the present invention to provide a door forcing apparatus applicable to a locked door which opens inward and, with the use of accessories, to any locked door.

It is another object of the present invention to provide a door forcing apparatus which is safely operable from a remote location so that the individuals operating it are not required to stand in front of the locked door while the door is being opened.

It is an additional object of the present invention to provide a mechanical door forcing apparatus which may be used by law enforcement or military personnel to open a locked door without exposing themselves to gun fire from the interior of the locked room or house.

It is a further object of the invention to provide a door forcing apparatus which can open a comparatively strong locked door which can not be forced manually or with a hand-held tool.

SUMMARY OF THE INVENTION

According to the invention the door forcing apparatus for opening a door mounted in a door jamb set in a wall comprises two side rails each having a substantially L-shaped cross section engagable with the door jamb or between the door jamb and the door, a plurality of wedge assemblies mounted on both side rails pivotable toward and engagable with the door, a plurality of adjustable braces each of which is pivotally attached to each of the side rails so that the door forcing apparatus may be collapsed when stored and the door forcing apparatus may be adjusted to fit various door widths and means for pivoting the wedge assemblies in the direction of the door and pressing the wedge assemblies against the door to open the door.

The wedge assembly comprises a drive wedge pivotally mounted on one of the side rails and a substantially flat foot pivotally mounted on the drive wedge pressible flat against the door. The drive wedge essentially comprises a portion of a circular disk having a circular-arc-shaped edge and two wedge edges converging to a vertex. It is oriented substantially perpendicular to the door. The foot is pivotally attached to the drive wedge on a foot pivot adjacent the circular-arc-shaped edge and is located between the drive wedge and the door. The pivotable drive wedge is advantageously mounted on a pivot supported on one side by the side rail and one the other side by a support bracket attached to the side rail. A guide having a guide plate preventing outward pivoting of the drive wedge during forcing of the door can also be provided near the circular-arc-shaped edge of the drive wedge.

The means for pivoting the wedge assemblies on one of the side rails in the direction of the door and pressing the feet of the drive wedges against the door to force the door comprises a driving hydraulic cylinder pivotally mounted at one end of each side rail and a drive rod pivotally attached to a piston rod of each driving hydraulic cylinder extending substantially in the longitudinal direction of the piston rod. The drive wedges of the wedge assemblies are pivotally attached to either of the two drive rods so that when the driving hydraulic cylinder is extended and moves the drive rods each of the drive wedges pivots toward the door pressing its foot against the door.

The adjustable brace can comprise a turnbuckle having two oppositely-threaded turnbuckle screws engaged in opposite ends of an interiorly-threaded center pipe. The ends of the turnbuckle screws not in the center pipe are pivotally attached to the side rails. Alternatively the adjustable brace can be a bracing hydraulic cylinder which can provide a substantially larger bracing force. This brace hydraulic cylinder can be activated from a remote location.

When the door forcing apparatus has been engaged on the door jamb of a door to be forced, the adjustable braces may be extended and the driving hydraulic cylinders are activated forcing the drive rods to move the drive wedges pressing the feet on the door and forcing it. Thus law enforcement or other personnel can force the door from a remote location not exposing themselves to gun fire from within the locked room or house while they are breaking down the door. If the door has been booby-trapped as drug dealers sometimes do, then, when it is opened from a remote location, law enforcement personnel are not injured.

Although there are many possible different embodiments of the door forcing apparatus and applications of it utilizing electric motors, magnetic coils, pneumatic and ratchet devices, to name a few, to apply the force and energy required to force a door and although there are many ways to engineer the wedge assemblies and the drive linkages, the detailed description for the most part concerns the embodiment illustrated in the drawing. However the specifics referred to below are not intended to limit the scope of the invention as set forth in the appended claims and the intent is to cover every possibility.

DETAILED DESCRIPTION OF THE DRAWING FIGURES

FIG. 1 is a perspective view of an embodiment of the door forcing apparatus for the present invention positioned against a locked door to be opened.

FIG. 1*a* is a cutaway perspective view of a portion of the door forcing apparatus of FIG. 1 for the present invention showing how space is provided for the handle of the door.

FIG. 2 is a perspective view of a lower portion of the door forcing apparatus of FIG. 1 showing how the drive rod for the wedge assemblies cooperates with the driving hydraulic cylinder.

FIG. 3 is a detailed perspective view showing how the hydraulic cylinder is connected to a drive wedge and to the drive rod.

FIG. 4 is a front elevational view of a cutaway portion of the door forcing apparatus of FIG. 1 showing how the width is adjustable.

FIG. 5 is a cutaway cross sectional view showing how the side rail of the door forcing apparatus engages the door jamb and the door in the embodiment of FIG. 1.

FIG. 6 is a side elevational view of a drive wedge and foot from the door forcing apparatus of FIG. 1 showing their connection to the drive rod and the side rail.

Figures 7, 7A, 7B:
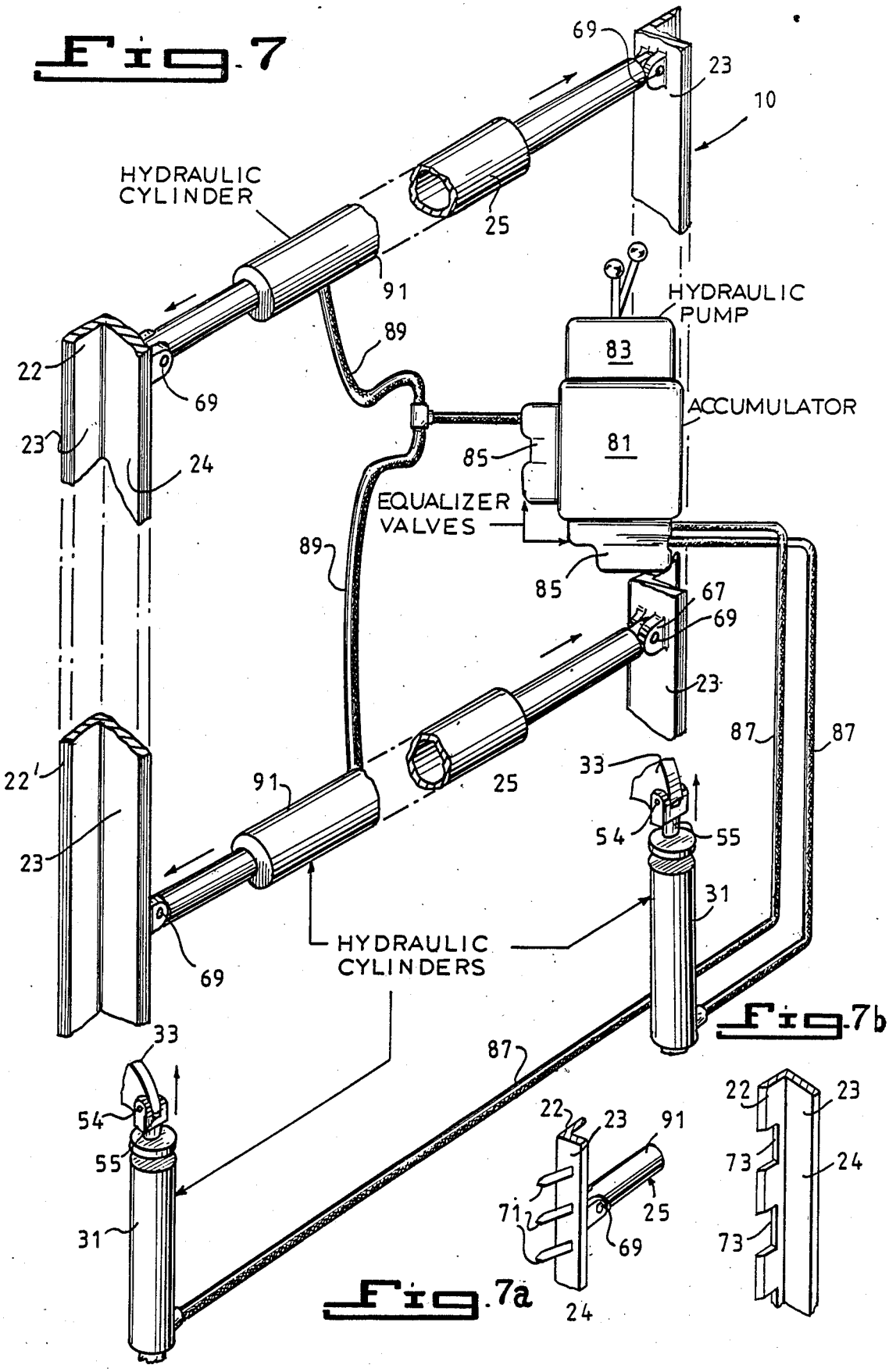

FIGS. 7, 7*a* and 7*b* are perspective views showing accessories the use of which allows the door forcing apparatus to be used with almost all types of doors, such as an outward opening door.

Figure 8:
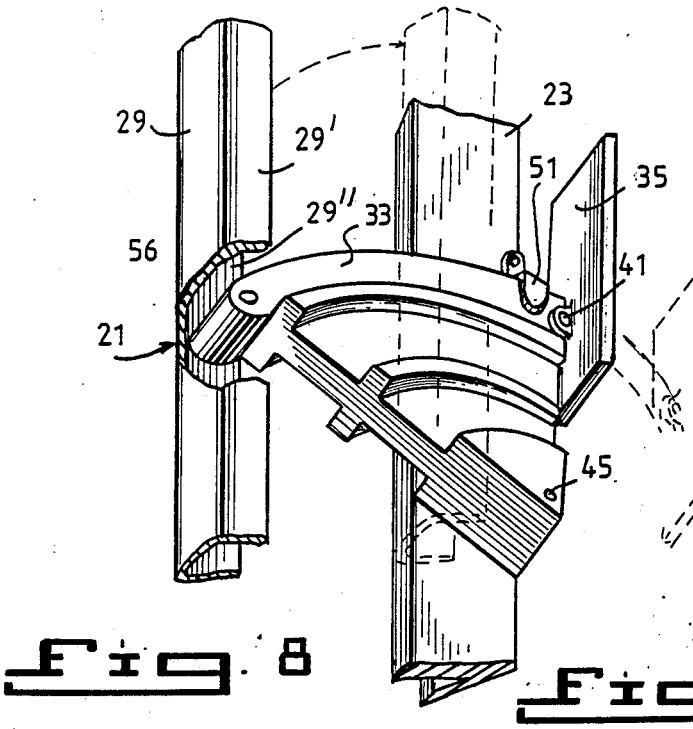

FIG. 8 is a perspective action view showing the operation of a wedge assembly from a door forcing apparatus according to the present invention.

Figure 9:
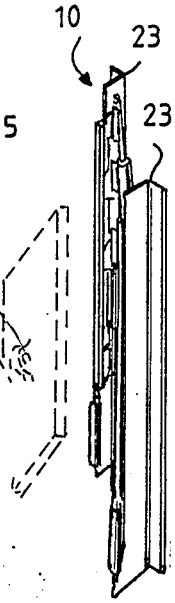

FIG. 9 is a perspective view of a door forcing apparatus according to the present invention in a collapsed state before being fit to the locked door.

Figure 10:
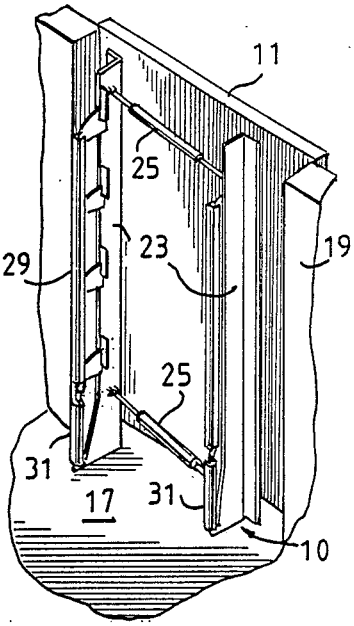

FIG. 10 is a perspective action view of the door forcing apparatus of FIG. 9 in an intermediate state with its side rails being positioned between the door jamb and the door.

Figure 11:
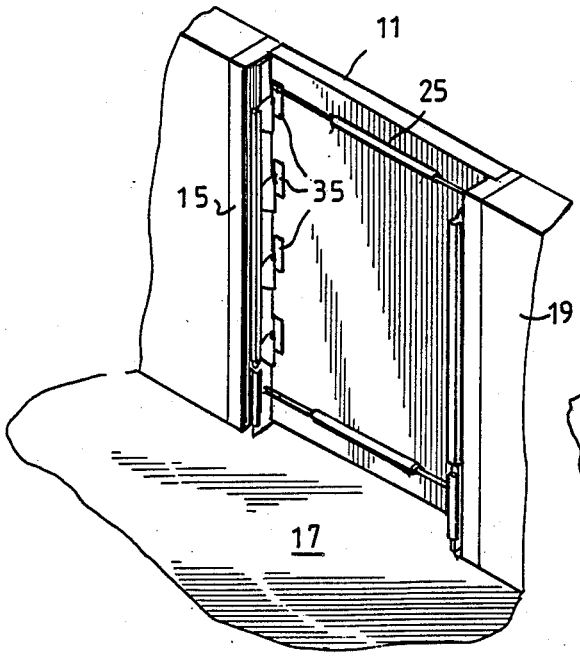

FIG. 11 is a perspective action view of the door forcing apparatus of FIG. 9 with its side rails engaged with the door jamb and with the feet of its wedge assemblies resting on the door.

Figure 12:
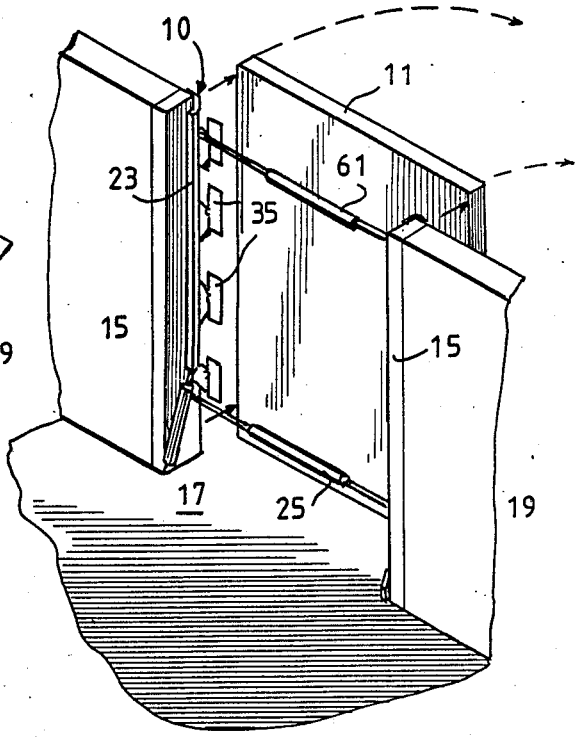

FIG. 12 is a perspective action view of the door forcing apparatus of FIG. 9 showing how the locked door is forced.

DETAILED DESCRIPTION OF THE INVENTION

The embodiment of the door forcing apparatus 10 shown in FIGS. 1 to 6 comprises two side rails 23 each having an L-shaped cross section engagable between the locked door 11 and the door jamb 15, two adjustable braces 25 whose width is adjustable so that the door forcing apparatus 10 can fit doors 11 of different widths, a plurality of wedge assemblies 21 attached pivotally to the side rails 23 which press on the facing surface of the door 11, two hydraulic cylinders 31 each of which is pivotally connected to a base bracket 27 of a side rail 23 and two drive rods 29 each of which is pivotally connected at one end to one of the hydraulic cylinders 31 and also pivotally connected to a group of the wedge assemblies 21 arranged in succession along the length of the drive rod 29.

In the embodiment shown in FIG. 1 five wedge assemblies 21 are mounted pivotally on each drive rod 29. The wedge assemblies 21 are spaced nearly equally from each other along the length of the drive rod 29 on the side of the door 11 which does not have the door handle 13. As shown in FIG. 1*a* there is a gap between the wedge assemblies 21 which is larger than normal because the center wedge assembly 21 is removed to allow for the presence of the door handle 13.

Each of the wedge assemblies 21 comprises a drive wedge 33 which is pivotally mounted on a supporting bracket 47 rigidly attached to a side rail 23 at wedge pivot pin 45 as shown in FIG. 6 and a pivotally attached foot 35. Each of the drive wedges 33 is pivotally attached to an advantageously rectangular, substantially flat foot 35 which is oriented substantially perpendicularly to the plane of the drive wedge 33 and which presses against the facing surface of the door 11. As shown by comparison of FIGS. 4 and 1*a* the drive wedge 33 is attached to the foot 35 at a distance 15 about ⅓ of the width of the foot 35 from the edge of the foot which is adjacent the side rail 23 and approximately centrally in regard to the length of the foot 35. The purpose of the foot 35 is of course to distribute the force applied to the door 11 over a comparatively wide area so the drive wedge 33 does not dig into the door 11.

The drive wedge 33 in this embodiment comprises a portion of a substantially circular disk having a circular-arc-shaped edge 32 and two straight wedge edges 34 approximately at right angles to each other for maximum inward displacement which meet at a vertex 75. The wedge pivot pin 45 is located adjacent the vertex 75. During its pivoting motion pushing the door 11 inward the drive wedge 33 is associated with a guide 51 attached rigidly to the side rail 23 as shown in FIG. 6. This one-piece guide 51 includes an approximately flat guide plate 52 which is substantially parallel to the surface of the drive wedge 33 and which is positioned so that the circular arc-shaped edge 32 is between it and the side rail 23 so that the drive wedge 33 is prevented from swinging away from the side rail 23 during operation. It is because of the presence of the guide 51 that the edge 32 must be substantially circular arc-shaped. The drive wedge 33 is also pivotally connected to a drive rod 29 which is movable by the driving hydraulic cylinder 31 so that the drive wedge 33 is pivoted toward the door 11 forcing it inward.

The pivotal attachment of the driving hydraulic cylinder 31 is to the drive wedge 33 is shown in detail in FIG. 3. The piston rod 57 of the driving hydraulic cylinder 31 has a U-shaped connector 55 attached rigidly at its end exterior to the driving hydraulic cylinder 31 with its arms extended in the longitudinal direction of the piston rod 57. A connector pivot 54 is attached between the arms of the U-shaped connector 55. The drive wedge 33 closest to the driving hydraulic cylinder 31 is pivotally attached to the bottom of the drive wedge 33 adjacent the circular arc-shaped edge 32. Immediately above the U-shaped connector 55 and the pivotal attachment at pivot 54 the U-shaped cross sectioned drive rod 29 is pivotally mounted on a drive rod pivot pin 56 on the drive wedge 33. Thus when the driving 15 hydraulic cylinder 31 extends the piston rod 57 as shown in FIG. 2 and 3 the drive wedge 33 swings toward the door 11 forcing the foot 35 against it and the U-shaped cross sectioned drive rod 29 is forced inward toward the door 11 pivoting on the drive rod pivot pin 56 to remain nearly vertical.

Two adjustable braces 25, each of which is of an adjustable width, connect the side rails 23. In the preferred embodiment the adjustable brace 25 can adjust so that the door forcing apparatus 10 fits doors from 27.5 to 47 inches wide. Larger or smaller braces can be used to allow the door forcing apparatus to fit almost any door. One adjustable brace 25 is attached between the side rails 23 adjacent each end of the pair of side rails 23 so that when the side rails 23 are braced against the door jamb 15 there is a large open space which is substantially the size of the doorway when the door 11 has been forced.

In the embodiment shown in FIGS. 1 to 4 each adjustable brace 25 comprises a turnbuckle having two oppositely threaded turnbuckle screws 65 and 63 engaged in opposite ends of an interiorly-threaded center pipe 61. The ends of the turnbuckle screws 65 and 63 not engaged in the center pipe 61 have pivots 69 rigidly attached. These pivots 69 may be short rods and are engaged in the pivot eyes 67 which are rigidly attached to the side rails 23. Thus each adjustable brace 25 is pivotally attached to each side rail 23 and during storage and transport the adjustable brace 25 can be collapsed with adjacent rails 23 pushed together as shown in FIG. 9. The pivots 69 only allow the side rails 23 to pivot up or down as in FIG. 9, but will support the side rails 23 so that force may be provided to thrust them into the door jamb as in FIG. 11.

An alternative embodiment in which the adjustable braces 25 are bracing hydraulic cylinders 91 is shown in FIG. 7. The hydraulic cylinders 91 allow automatic remote application of a larger bracing force than can be provided with the turnbuckle arrangement in the embodiment of FIGS. 1 to 4. The piston rods of the bracing hydraulic cylinders 91 are each pivotally connected to one of the side rails 23 as in the embodiment described in the previous paragraph.

The bracing hydraulic cylinders 91 are connected with a hydraulic pump 83 and an accumulator or reservoir 81 for hydraulic fluid 81 which also supplies hydraulic fluid to the driving hydraulic cylinders 31 for the drive rods 29. The accumulator 81 is connected by 15 hydraulic lines 89 and 87 through equalizer valves 85 20 with the hydraulic cylinders 91 and 87 respectively. The equalizer valves act to prevent an unequal distribution of pressure on the two sides of the door forcing apparatus 10.

In the embodiment of FIGS. 1 to 4 the side rails 23 as shown in FIG. 5 have an L-shaped cross section. They each comprise one flat side rail piece 24 which is attached to the adjustable brace 25 and another flat side rail piece 22 attached at right angles to it which engages with a beveled edge 22' between the door jamb 15 and the door 11. Advantageously this side rail piece 22 is about 1/16 of an inch. Other embodiments of the invention differ in the form of the side rails 23 as shown in FIG. *7a* and *7b*. In the embodiment of FIG. *7a* the angle iron piece which comprises the side rail 23 is reversed so that the side rail piece 22 faces away from the door jamb 15 and not toward it. Instead prongs 71 are rigidly attached to the side rail piece 24 and extend outwardly from it toward the door jamb 15. When the adjustable braces 25 are extended these prongs 71 engage in the door jamb 15 and hold the apparatus fixed while it forces the door 11. For example outwardly opening doors can be forced this way. In the embodiment shown in FIG. *7b* the side rail 23 is almost identical with the side rail 23 in the embodiment of FIGS. 1 to 4. The difference is that the side rail piece 22 has recesses 73 cut into it.

Many methods of attachment may be used in the door forcing apparatus 10 which can be changed without modifying the character of the invention. The flat foot 35 may be provided with an attached comparatively strong pivot eye 43 in which a foot pivot 41 rigidly attached to the upper portion of a drive wedge 33 adjacent the circular arc shaped edge 32 engages pivotally. The drive rod 29 may have a U-shaped cross section so that a drive rod pivot pin 56 which is pivotally engaged in the bottom portion of the drive wedge 33 may be rigidly attached between the facing arm portions 29',29" of the U-shaped-cross-sectioned drive rod 29. This provides an especially strong pivotal connection between the drive rod 29 and the drive wedge 33, necessary in view of the large forces that must be applied to the drive wedge 33 to force the door 11. When the side rail 29 is driven pressing the drive wedge 33 with the foot 35 into the door 11, it eventually takes a position adjacent the side rail 23 as shown in FIG. 8. Furthermore the lower edge of the flat foot 35 pressing on the door 11 is slightly rounded off so that the flat foot does not dig into the door 11 as it forces the door.

The side rails are advantageously of a length such that any of a variety of doors 11 may be opened. In the case of the embodiment of FIG. 1 this length is about 6 feet.

The operation of the door forcing apparatus 10 is shown in FIGS. 9 to 12. When stored the pivotal attachment of both ends of the adjustable braces 25 allows the side rails 23 to be collapsed. First the side rails 23 are moved apart until the adjustable braces 25 are approximately perpendicular to both side rails 23 as shown in FIG. 10. This is done as quickly and as quietly as possible. Then the adjustable braces 25 are extended forcing the side rails 23 to engage the door jamb 15 or to engage between the door jamb 15 and the door 11 either by turning the turnbuckle center pipe 61 or by pressurizing the hydraulic cylinders 91 as shown in FIG. 11. Ratchet type devices and other types of devices can be used to force the side rails into the door jambs also. Finally the hydraulic cylinders 31 are extended forcing the drive rods 29 upward and toward the door 11, pushing the drive wedges 33 toward the door 11 and pressing the feet 35 on the facing surface of the door 11 to force it inward, The force that drives the drive rod in turn driving the wedges may be obtained through a variety of other methods not mentioned, such as magnetic coils, electric motors or a ratchet device similar to that used in automotive bumper jacks for example.

It will be understood that each of the elements described above, or two or more together, may also find a useful application in other devices differing from the type of device described above.

The invention is not intended to be limited to the details provided above and it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of the prior art, fairly constitute essential characteristics of the generic or specific aspects of this invention.

What is claimed is new and what is desired to be protected by Letters Patent is set forth in the following claims:

1. A door forcing apparatus for forcing a door mounted in a door jamb set in a wall comprising:

two side rails each having a substantially L-shaped cross section engagable with said door jamb or between said door jamb and said door;

a plurality of wedge assemblies mounted on said side rails pivotable toward and engagable with said door;

a plurality of adjustable braces each of which is pivotally attached to each of said side rails so that said door forcing apparatus may be collapsed when stored and so that said door forcing apparatus may be adjusted to fit various door widths; and means for pivoting said wedge assemblies in the direction of said door and pressing said wedge assemblies against said door to force said door.

2. A door forcing apparatus according to claim 1 in which said wedge assembly comprises a drive wedge pivotally mounted on one of said side rails, said drive wedge essentially comprising a portion of a circular disk having a circular-arc-shaped edge and two wedge edges converging to a vertex and being oriented substantially perpendicular to said door, and a substantially flat foot positioned between said drive wedge and said door, oriented substantially perpendicular to said drive wedge and pivotally attached to said drive wedge so as to remain flat against said door while pressing on said door, said drive wedge being pivotally attached to said side rail on a wedge pivot pin adjacent said vertex and said foot being pivotally attached to said drive wedge on a foot pivot adjacent said circular-arc-shaped edge.

3. A door forcing apparatus according claim 2 additionally comprising a guide attached to said side rail adjacent said circular-arc-shaped edge of said drive wedge having a guide plate which acts to restrain said drive wedge from swinging away from said side rail when said drive wedge is pivoted.

4. A door forcing apparatus according to claim 1 wherein said means for pivoting said wedge assemblies on one of said side rails and pressing said wedge assemblies against said door to force said door comprises a driving hydraulic cylinder pivotally attached at one end of said side rail and a drive rod pivotally attached to a piston rod of said driving hydraulic cylinder extending substantially in the longitudinal direction of said piston rod, said drive wedges of said wedge assemblies being pivotally attached to said drive rod so that when said hydraulic cylinder is extended and moves said drive rod each of said drive wedges pivots toward said door pressing said foot against said door to force said door.

5. A door forcing apparatus according to claim 1 in which said adjustable brace comprises a turnbuckle having two oppositely-threaded turnbuckle screws engaged in opposite ends of an interiorly-threaded center pipe.

6. A door forcing apparatus according to claim 1 in which said adjustable brace comprises a bracing hydraulic cylinder.

7. A door forcing apparatus for forcing a door mounted in a door jamb set in a wall comprising:

two side rails each having a substantially L-shaped cross section engagable with a beveled edge between said door jamb and said door;

a plurality of wedge assemblies mounted on said side rails pivotable toward and engagable with said door, each of said wedge assembly comprising a drive wedge pivotally mounted on one of said side rails, said drive wedge essentially comprising a portion of a circular disk having a circular-arc-shaped edge and two wedge edges converging to a vertex and being oriented substantially perpendicular to said door, and a substantially flat foot positioned between said drive wedge and said door, oriented substantially perpendicular to said drive wedge and pivotally attached to said drive wedge adjacent said circular-arc-shaped edge so as to remain flat against said door while pressing on said door, said drive wedge being pivotally attached to said side rail on a wedge pivot pin adjacent said vertex and having a guide attached to said side rail adjacent said circular-arc-shaped edge of said drive wedge having a guide plate which acts to restrain said drive wedge from swinging away from said side rail when said drive wedge is pivoted;

a plurality of adjustable braces each comprising a bracing hydraulic cylinder which is pivotally attached between each of said side rails so that said door forcing apparatus may be collapsed when stored and so that said door forcing apparatus may be adjusted to fit various door widths; two U-shaped cross sectioned drive rod, each having twin arm portions between which said drive wedges pivotally mounted on one of said side rails are pivotally mounted, said wedge assemblies being spaced as uniformly as possible from each other allowing for a knob assembly of said door; and two driving hydraulic cylinders, each of which has a piston rod pivotally attached to an end of one of said drive rods and is pivotally mounted on a support bracket at one end of said side rail connected to said drive rod so that, when said piston rods are extended from said driving hydraulic cylinders, said drive rods move pivoting said drive wedges pivotally mounted on both of said side rails, pressing said feet against said floor and thus forcing said door.

8. A door forcing apparatus according to claim 7 which has two of said adjustable braces at each end of said apparatus and four of said wedge assemblies spaced as uniformly as possible along each of said side rails.

* * * * *